US006731571B2

(12) United States Patent
Yiu

(10) Patent No.: US 6,731,571 B2
(45) Date of Patent: May 4, 2004

(54) POSITION DETECTING AND CORRECTING DEVICE FOR TIMEPIECE

(76) Inventor: Chih Hao Yiu, 17F-B, No. 306, Junggang Road, Taichung (TW), 404

( * ) Notice: Subject to any disclaimer, the term of this patent is extended or adjusted under 35 U.S.C. 154(b) by 13 days.

(21) Appl. No.: 10/263,559

(22) Filed: Oct. 4, 2002

(65) Prior Publication Data

US 2004/0022134 A1 Feb. 5, 2004

(30) Foreign Application Priority Data

Aug. 2, 2002 (TW) ..... 91117612 A

(51) Int. Cl.[7] ..... G04C 17/00

(52) U.S. Cl. ..... 368/79; 368/76; 368/77; 250/231.15; 356/375

(58) Field of Search ..... 368/80, 157, 187, 368/76, 155, 156

(56) References Cited

U.S. PATENT DOCUMENTS 4,117,661 A 10/1978 Bryant, Jr. ..... 58/24 R
4,204,398 A 5/1980 Lemelson ..... 368/47
4,358,753 A 11/1982 Cascini ..... 340/347 P
4,700,062 A 10/1987 Ernst ..... 250/231 SE
5,231,612 A 7/1993 Allgaier et al. ..... 368/47
5,566,140 A 10/1996 Kohata et al. ..... 368/220
5,640,007 A 6/1997 Talbott et al. ..... 250/231.15
5,734,474 A * 3/1998 Haecker et al. ..... 356/623
5,930,205 A 7/1999 Baba et al. ..... 368/80

* cited by examiner

*Primary Examiner*—David Martin
*Assistant Examiner*—Jeanne-Marguerite Goodwin
(74) *Attorney, Agent, or Firm*—Charles E. Baxley

(57) ABSTRACT

A timepiece includes a reference wheel and a target wheel each having one or more reflective members for reflecting a light generated from a light emitting device. The position of the reference wheel may be positively determined when receiving a starting code which includes one or more "off" signals and one or more "on" signals reflected by the reflective member of the reference wheel. The reference wheel may be quickly rotated to align an orifice with the light emitting device, for allowing the light to be reflected by the reflective member of the target wheel.

6 Claims, 5 Drawing Sheets

POSITION DETECTING AND CORRECTING DEVICE FOR TIMEPIECE

BACKGROUND OF THE INVENTION

1. Field of the Invention

The present invention relates to a timepiece, and more particularly to a timepiece including a device for detecting and correcting the relative positions of rotary members and/or hands thereof.

2. Description of the Prior Art

Various kinds of typical timepieces have been developed, and may be used for automatically setting or detecting or correcting the time or the rotary members or the hands thereof. In addition, the various kinds of typical timepieces may be used for receiving the time signals from the National Bureau of Standards (NBS), the radio stations, or the like, and may correct or set the time accordingly.

U.S. Pat. No. 4,117,661 to Bryant, Jr., and U.S. Pat. No. 4,204,398 to Lemelson disclose two of the typical timepieces, and comprise a complicated electric circuit for detecting and/or decoding and/or correcting the time of the timepieces.

U.S. Pat. No. 4,358,753 to Cascini, U.S. Pat. No. 5,566,140 to Kohata et al., U.S. Pat. No. 5,640,007 to Talbott et al., and U.S. Pat. No. 5,930,205 to Baba et al. disclose the other four typical timepieces, and each may include a number of illumination devices, scanning devices, photo elements for emitting and receiving lights respectively, to detect and to correct the positions of the wheels and/or hands.

In most of the typical timepieces, a number of rotary wheels are required to be provided and coupled between the hands and the motors, such as the step motors, for allowing the hands to be rotated or driven by the motors. The rotary wheels each may include one or more holes or orifices, and the holes or orifices of all of the three rotary wheels should be aligned with each other for allowing the lights generated by the light or illumination devices to be emitted through the holes or orifices of the rotary wheels.

Accordingly, a complicated mechanism or device or configuration is required to be provided for detecting or determining whether the holes or orifices are aligned with each other. The light may only be emitted through the holes or orifices of the rotary wheels by chance.

U.S. Pat. No. 5,231,612 to Allgaier et al. discloses a further typical timepiece including a reflex barrier or a detecting device disposed on one side of a number of wheels, and having a sending part and a receiving part, and a rear mirror disposed on the other side of the wheels.

The wheels of the typical timepieces each includes a number of holes or orifices formed therein for receiving the lights emitted by the illumination device. The holes of the wheels should be aligned with each other for allowing the light to emit through the holes of the wheels simultaneously, and for allowing the lights to be reflected to the receiving parts of the detecting device.

However, it may take a long time before the holes of the wheels may be aligned with each other. For some of the typical timepieces, it may take twelve hours or even twenty four hours for allowing the holes of the wheels to be aligned with each other, and for allowing the light to emit through the holes of the wheels simultaneously.

Particularly, the first wheel that faces the reflex barrier includes a reflective wheel disk disposed thereon for reflecting the light generated by the light devices. The reflective wheel disk includes a single hole for allowing the light to emit through the hole of the reflective wheel disk. However, no other devices or mechanisms may be provided for positively determining or locating the hole of the reflective wheel disk, such that the timepiece may not readily know whether the light has been aligned with the hole of the reflective wheel disk or not, and should determine the alignment of the hole of the reflective wheel disk with the reflex barrier with try and error methods.

U.S. Pat. No. 4,700,062 to Ernst discloses a further timepiece including a reference mark for determining the zero point of an incremental scale, and for being aligned or scanned through the corresponding scanning aperture of the scanning plate.

However, similarly, the wheels or plates should all include a number of holes provided therein. In addition, a number of illumination devices are required to be provided for generating lights through various holes or orifices of the wheels or plates. Furthermore, the timepiece also should determine the alignment of the hole of the reflective wheel disk with the illumination device with try and error methods.

The present invention has arisen to mitigate and/or obviate the afore-described disadvantages of the conventional timepieces.

SUMMARY OF THE INVENTION

The primary objective of the present invention is to provide a timepiece including a simplified device or configuration for detecting and correcting the relative positions of rotary members and hands of the timepiece.

The other objective of the present invention is to provide a timepiece including an initializing or starting code for positively determining the aperture of the first rotary member and thus for easily and readily detecting and correcting the relative positions of rotary members and hands of the timepiece.

In accordance with one aspect of the invention, there is provided a timepiece comprising a light emitting device for generating a light, a reference wheel including at least one first reflective member provided thereon for reflecting the light generated by the light emitting device, and at least one orifice formed therein for receiving the light generated by the light emitting device, a first driving means for driving the reference wheel, a target wheel including at least one second reflective member provided thereon for reflecting the light generated by the light emitting device, a second driving means for driving the target wheel, a light receiving device for receiving the light reflected from either the first reflective member or the second reflective member, to determine at least one first "on" signal when the light receiving device receives the light reflected from the first reflective member, and to determine at least one second "on" signal when the light receiving device receives the light reflected from the second reflective member, and to determine at least one "off" signal when the light receiving device receives no light reflected from either the first reflective member or the second reflective member, and to determine a starting code with the first "on" signal and the "off" signal, and processor means for actuating the first driving means to rotate the reference wheel and to align the orifice of the reference wheel with the light emitting device and to allow the light generated by the light emitting device to emit through the orifice of the reference wheel when the processor means receives the starting code from the light- receiving device. The processor means may be provided for actuating the second driving means to rotate the target wheel and to align the second reflective member of the target wheel with the light emitting device after the orifice of the reference wheel is aligned with the light emitting device.

The first "on" signal of the starting code may be provided after or before the "off" signal of the starting code.

A memorizing device may further be provided for storing a time signal, the processor means may be provided for actuating the first and the second driving means to rotate the reference wheel and the target wheel and to the time signal stored in the memorizing means.

A device may further be provided for receiving the time signal from such as the NBS or from the radio stations, and for sending the time signal to the memorizing device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
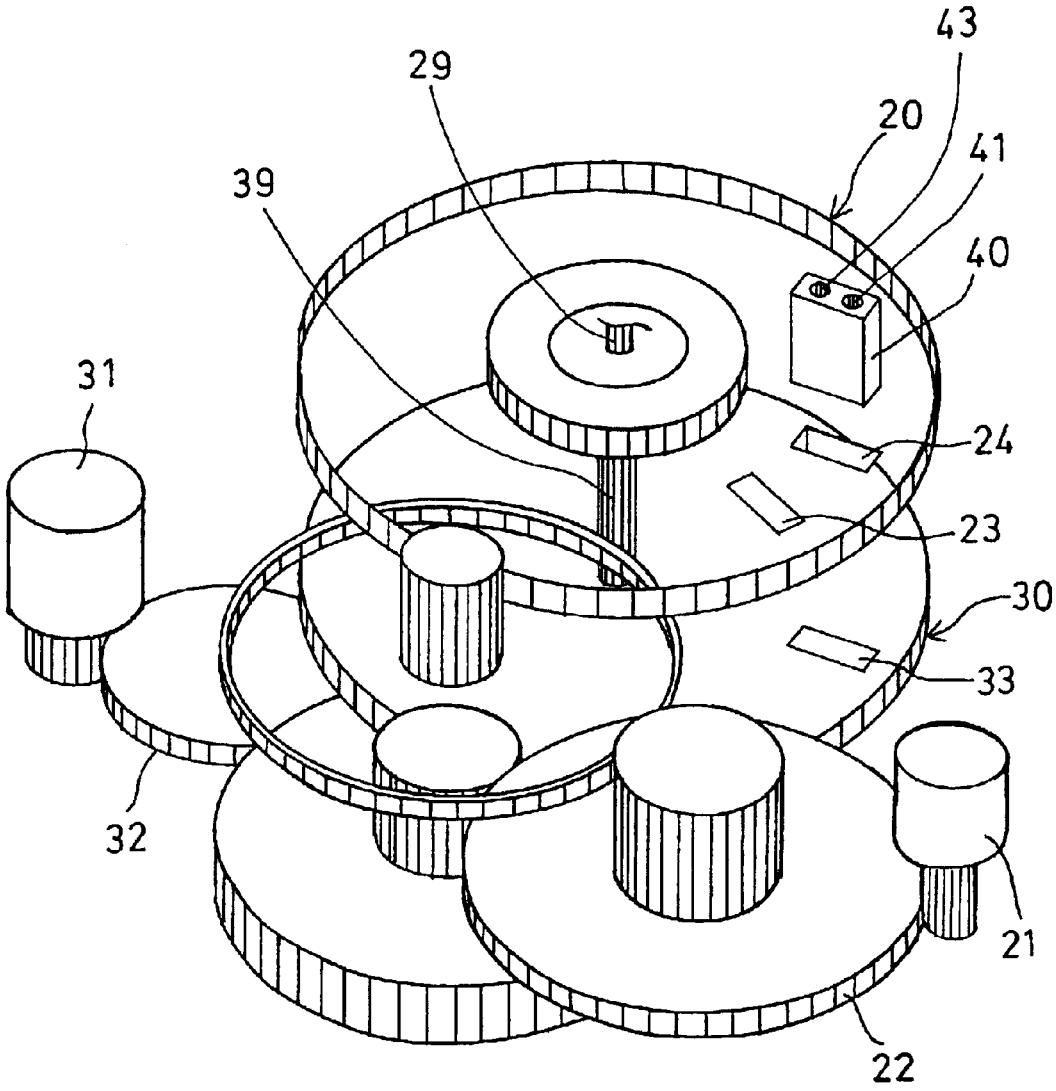
FIG. 1 is a partial perspective view of a timepiece in accordance with the present invention.
Figure 2:
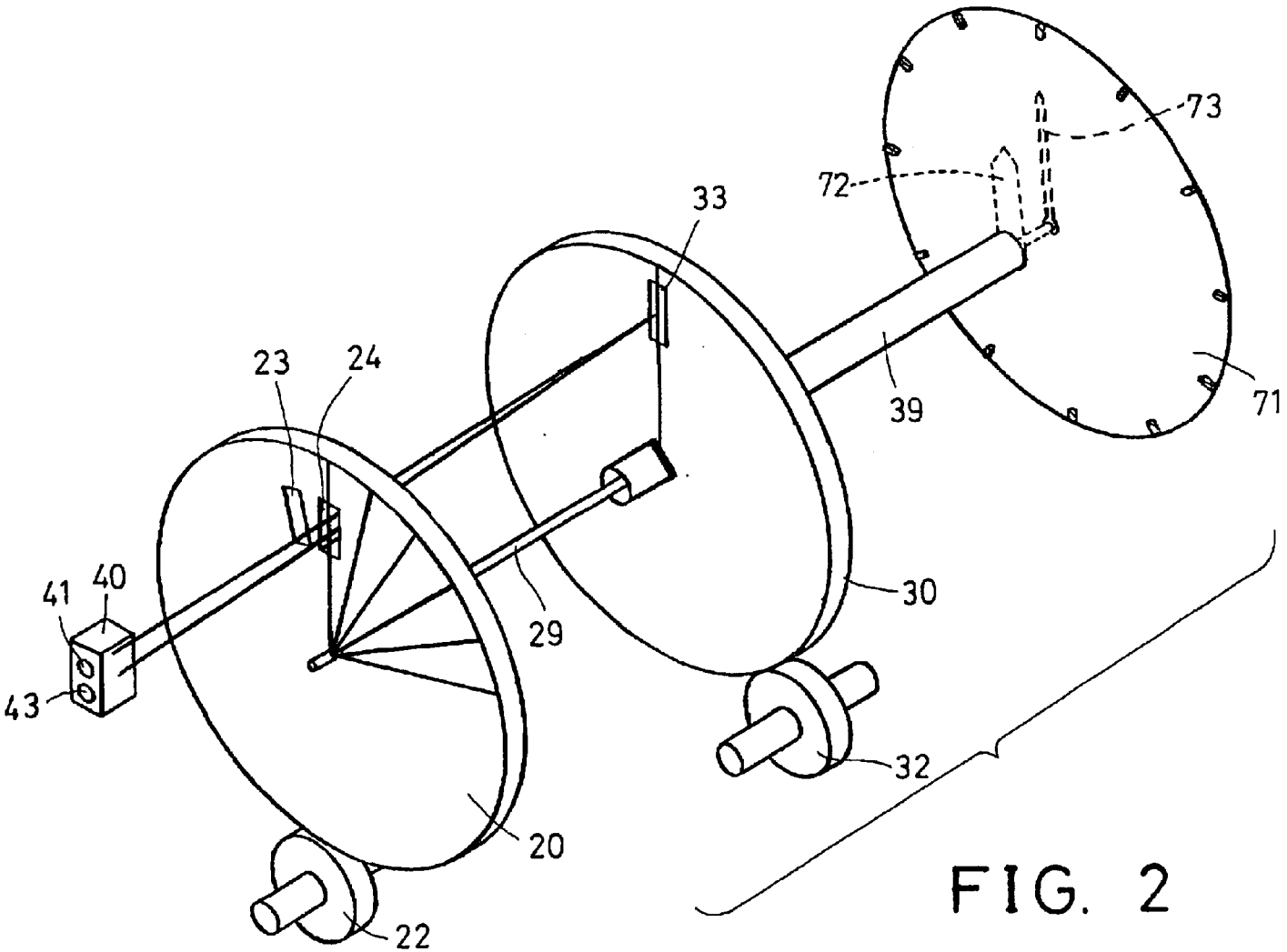
FIG. 2 is a partial exploded view of the timepiece.
Figure 3:
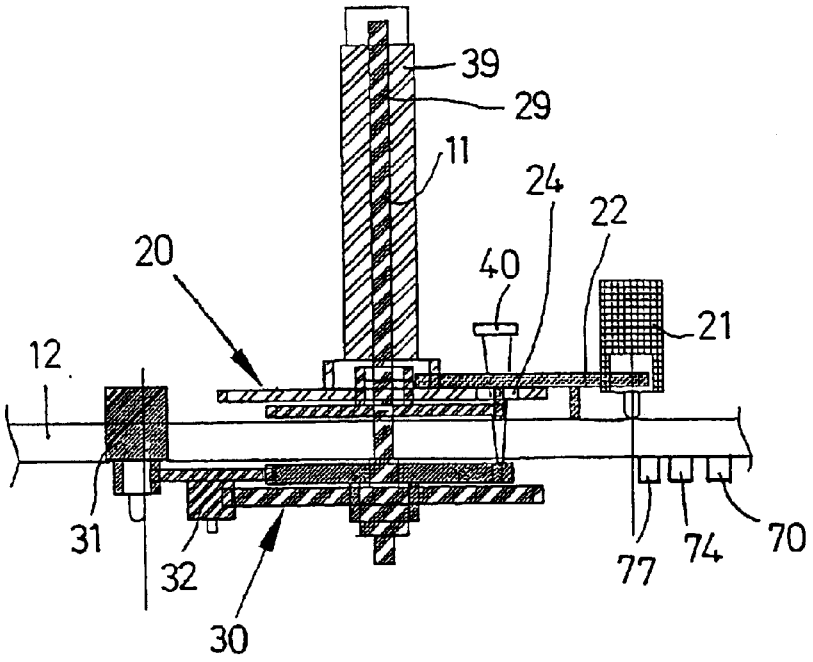
FIG. 3 is a partial cross sectional view of the timepiece.
Figure 4:
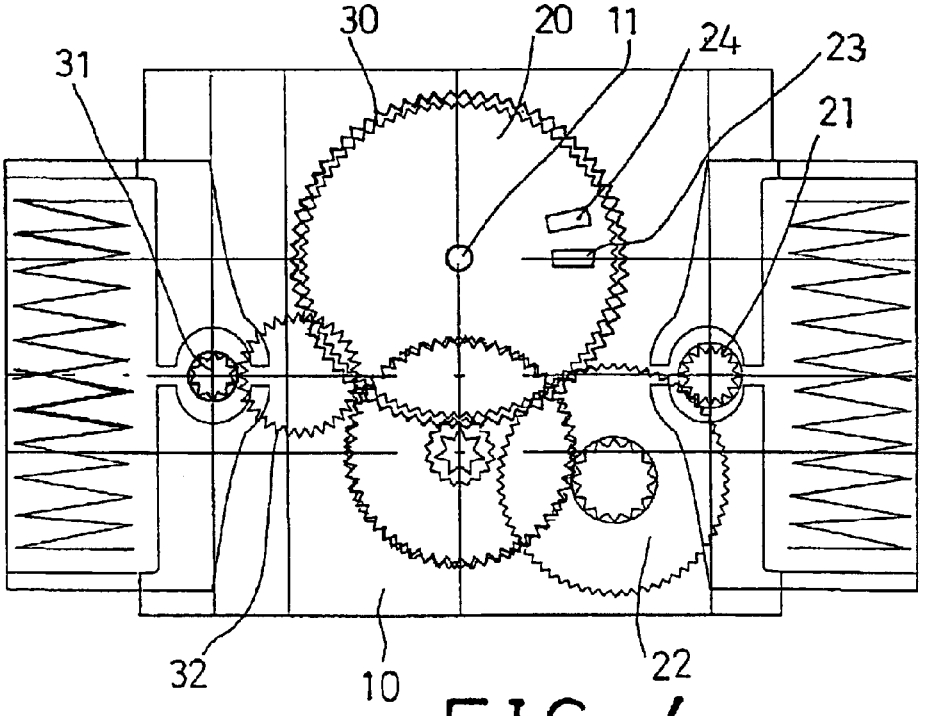
FIG. 4 is a top plan schematic view of the timepiece.

Referring to the drawings, and initially to FIGS. 1–4, a timepiece in accordance with the present invention comprises a reference wheel 20 which may be either a second, a minute, or an hour wheel, and a target wheel 30 which may also be either an hour wheel, a minute wheel, or a second wheel. The timepiece includes a housing 10 for receiving and supporting the wheels 20, 30.

The timepiece in accordance with the present invention is to provide a device or a mechanism to readily or quickly determine the relative or positive positions of the reference wheel 20 and the target wheel 30. The reference wheel 20 and the target wheel 30 are coupled to a respective hand 73, 72 each, for driving or rotating the respective hands 73, 72 relative to the clock face 71.

The reference wheel 20 and the target wheel 30 may be rotatably supported in a rotary axis 11 of the housing 10 with an axle 29 and a shaft 39 respectively, and/or rotatably supported on a supporting board 12 of the housing 10, for allowing the wheels 20, 30 to be rotated independently and to be rotated relative to each other.

Two driving devices 21, 31, such as two step motors 21, 31 are provided and disposed in the housing 10, and are coupled to the reference wheel 20 and the target wheel 30 respectively with gear couplings 22, 32 respectively, or with the other or similar transmission couplings, for allowing the reference wheel 20 and the target wheel 30 to be rotated or driven by the step motors 21, 31 separately or independently.

A detecting device 40 includes a light emitting part or device 41 for generating lights, and a light receiving part or device 43 for receiving reflective lights. It is to be noted that timepiece in accordance with the present invention requires only a single detecting device 40 which is good enough to determine the relative or positive positions of the reference wheel 20 and the target wheel 30 and the hands 72, 73.

The reference wheel 20 includes an initializing or starting code or device having such as a reflective member 23 disposed on the reference wheel 20 for reflecting the light generated by the light emitting device 41 of the detecting device 40. The reference wheel 20 further includes an orifice 24 formed therein for allowing the light to emit therethrough.

The reference wheel 20 is preferably made of the materials that may not reflect the lights, such as the plastic or synthetic materials. Only the reflective member 23 may be used to reflect the light generated by the light emitting device 41 of the detecting device 40. The target wheel 30 also includes a reflective member 33 to reflect the light to the light receiving device 43. The reference wheel 20 is arranged between the target wheel 30 and the detecting device 40.

The timepiece may include a receiver device 70, such as the typical time signal receiver device for receiving the time signals from the National Bureau of Standards (NBS), or the radio stations, or the like. A processor device 74 may include a memory device 77 for storing the time signals from the NBS or from the radio stations, and/or for storing the time signals or positions of the wheels 20, 30 and the motors 21, 31.

The processor device 74 may be coupled to the light emitting device 41 and the light receiving device 43 of the detecting device 40, for receiving the signals, such as the pulse signals therefrom, and may be coupled to the step motors 21, 31 for actuating or controlling the step motors 21, 31 to rotate or to drive the wheels 20, 30 respectively.

The light emitting device 41 of the detecting device 40 may generate or emit lights continuously or intermittently onto the reference wheel 20 and/or the target wheel 30. For example, as represent by "E" in FIG. 11, the light emitting device 41 of the detecting device 40 may generate or emit lights continuously or intermittently onto the reference wheel 20 and/or the target wheel 30 in at least the steps 1–6.

Figure 5:
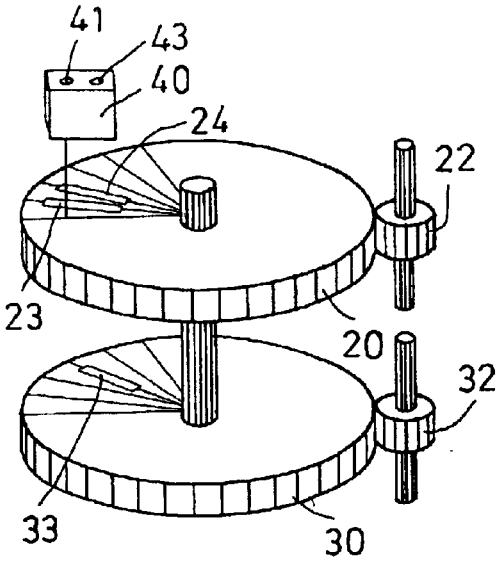
FIGS. 5, 6, 7, 8, 9, 10 are partial perspective views illustrating the operation of the timepiece.

In operation, as shown in FIGS. 5–10, and initially in FIG. 5, when the reflective member 23 of the reference wheel 20 is not aligned with the light emitting device 41 of the detecting device 40, the reference wheel 20 will not reflect the light, such that the light receiving device 43 of the detecting device 40 will not receive any signal, and may have an "off" signal as shown in step 1 of the receiving part "R" which represents the signals received by the light receiving device 43 of the detecting device 40.

Figure 6:
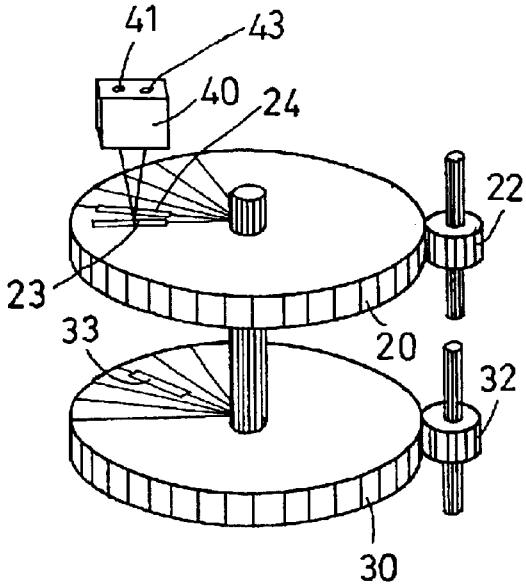
Figure 7:
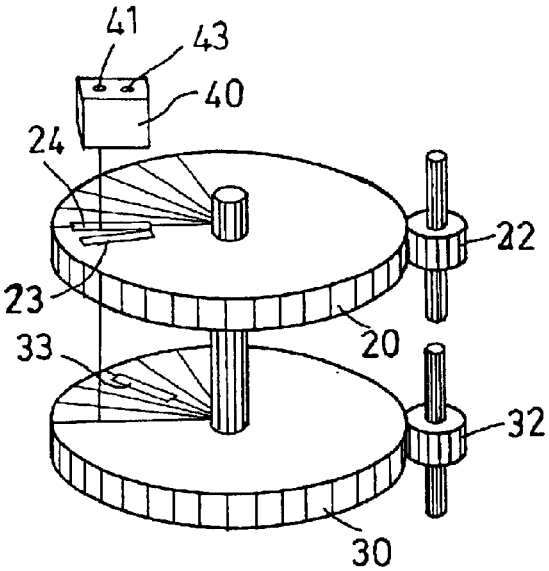
Figure 8:
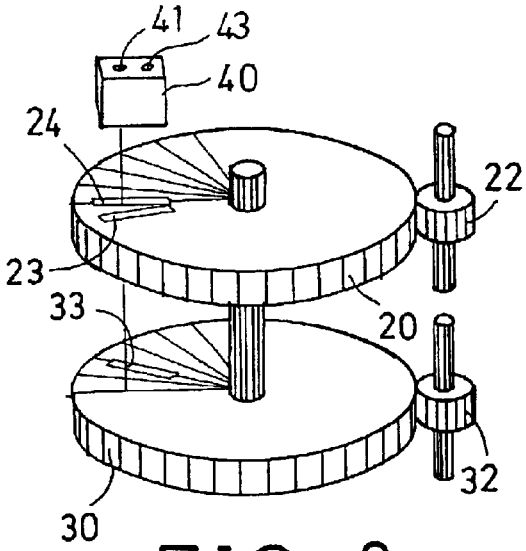
Figure 9:
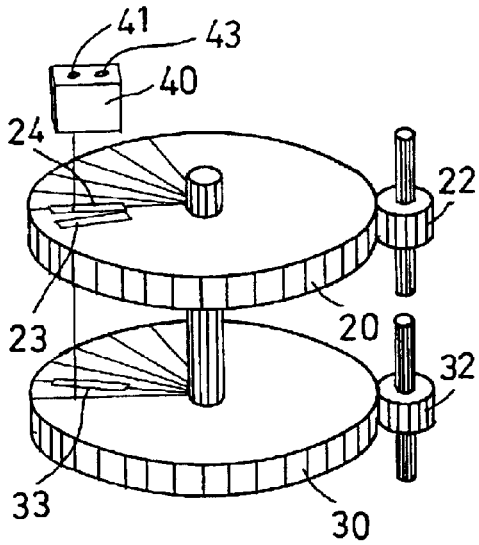

As shown in FIG. 6, when the reflective member 23 of the reference wheel 20 is aligned with the light emitting device 41 of the detecting device 40, the reflective member 23 may reflect the light, such that the light receiving device 43 of the detecting device 40 will receive a signal, such as a pulse or an "on" signal, as shown in step 2 of the receiving part "R".

At this moment, when the processor device 74 receives one "off" signal and one "on" signal from the light receiving device 43, the processor device 74 may then determine and locate the position of the reference wheel 20. For example, the position or the location of the reflective member 23 of the reference wheel 20 relative to the clock face 71 or relative to the housing 10 may be predetermined and located or stored in such as the memory device 77.

Once the position or the location of the reflective member 23 of the reference wheel 20 relative to the clock face 71 or relative to the housing 10 has been determined or located, the processor device 74 may actuate the driving device or the step motor 21 to rotate the reference wheel 20 one or more steps forward, and to align the orifice 24 of the reference wheel 20 with the light generated by the light emitting device 41.

In addition, the orifice 24 of the reference wheel 20 may be maintained at the position aligning with the light emitting device 41, by the driving device or the step motor 21 and by the processor device 74, for allowing the light to emit through the orifice 24 of the reference wheel 20 continuously for a period of time (FIGS. 7–10).

The light emitting device 41 of the detecting device 40 may be energized or started to emit the light in order to determine the relative or positive positions between or of the reference wheel 20 and the target wheel 30 and the hands 72, 73 at any time by the processor device 74, such that there may have one or more "off" signals to be received before receiving the reflected or "on" signal. However, for illustrating purposes, only one "off" signal has been illustrated or shown in FIGS. 5–11.

The orifice 24 of the reference wheel 20 may be separated from the reflective member 23 of the reference wheel 20 for one or more steps away from each other, such that the reference wheel 20 may be rotated or driven quickly by the step motor 21, for one or more steps to align the orifice 24 of the reference wheel 20 with the light emitting device 41.

Figure 10:
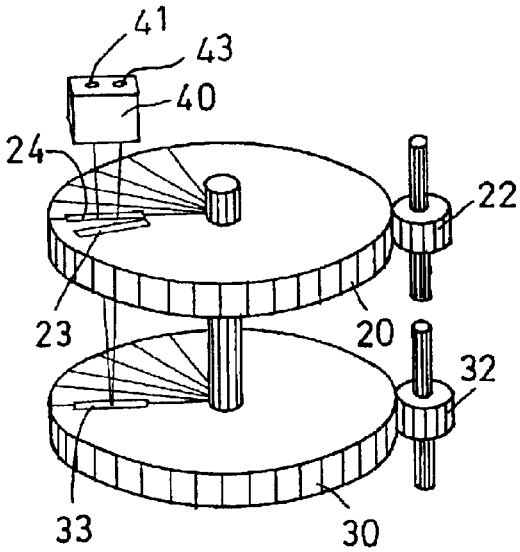

As shown in FIGS. 7–10, after the light has been determined or located to be emitted through the orifice 24 of the reference wheel 20 continuously, the target wheel 30 may be quickly rotated relative to the reference wheel 20 until the reflective member 33 of the target wheel 30 is aligned with the orifice 24 of the reference wheel 20, in order to reflect the light to the light receiving device 43 (FIG. 10).

Figure 11:
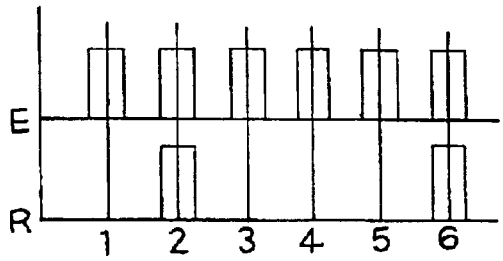
FIG. 11 is a a diagram illustrating the signals emitted and received by the detecting device.

It is also to be noted that one or more more "off" signals (steps 3–5 of FIG. 11) may be received before receiving the reflected or "on" signal (step 6 of FIG. 11). However, for illustrating purposes, three "off" signals have been illustrated or shown in FIGS. 7–9.

The reflective member 33 of the target wheel 30 may also be aligned with the orifice 24 of the reference wheel 20 right after the light has been determined or located to be emitted through the orifice 24 of the reference wheel 20. In such a situation, no "off" signals may be received before receiving the reflected or "on" signal; i.e., the "on" signal of the step 6 of FIG. 11 may also have a chance to be received in step 3 right after receiving the "on" signal in step 2 of FIG. 11.

Alternatively, the processor device 74 may control the light receiving device 43 to wait until receiving a reflected light from the reflective member 33 of the target wheel 30, and thus to receive or to generate a single "on" signal after the light has been determined or located to be emitted through the orifice 24 of the reference wheel 20.

Once the light receiving device 43 receives the reflected light from the reflective member 33 of the target wheel 30, the relative or positive positions between or of the reference wheel 20 and the target wheel 30 and the hands 72, 73 relative to the clock face 71 may thus be determined. For example, at this moment, the hands 72, 73 may be indicated to "0" second, or "0" minute, or "0" or "12" o'clock.

When the target wheel 30 is further rotated relative to the reference wheel 20 for one or more steps, the reflective member 33 of the target wheel 30 may be moved away from or offset from the light receiving device 43, such that the light receiving device 43 will not receive the reflected light from the reflective member 33 of the target wheel 30, and such that one or more "off" signals may further be received or generated by the light receiving device 43.

The "on" and the "off" signals from the target wheel 30 and from the reflective member 33 of the target wheel 30 may thus be provided for further precisely determining the relative or positive positions between or of the reference wheel 20 and the target wheel 30 and the hands 72, 73 relative to the clock face 71.

After the positions of the reference wheel 20 and the target wheel 30 and/or the hands 72, 73 have been determined, the processor device 74 may then actuate the step motors 21, 31 to quickly rotate the wheels 20, 30 and the hands 73, 72 to the time memorized or stored in the memory device 77. The timepiece may thus be easily and quickly corrected.

The timepiece includes a greatly simplified configuration having only one detecting device 40, and the reference wheel 20 include only one reflective member 23 and an orifice 24 spaced from each other, and the target wheel 30 includes only one reflective member 33, for allowing the timepiece to be easily and quickly corrected to the correct or standard time.

The reflective member 23 and the orifice 24 of the reference wheel 20 are spaced from each other, such that the light receiving device 43 may receive one or more "off" signals before or after receiving the one or more "on" signals generated by the reflected light from the reflective member 23 of the reference wheel 20.

Accordingly, the one or more "on" signals generated by the reflected light from the reflective member 23 of the reference wheel 20, and the one or more "off" signals before or after the "on" signals from the reflective member 23 of the reference wheel 20 may be used as an initializing or starting code, to determine the location of the reflective member 23 of the reference wheel 20, and to quickly locate or position or align the orifice 24 of the reference wheel 20 with the detecting device 40.

Alternatively, the target wheel 30 may include a peripheral reflective member for continuously reflecting the light to the light receiving device 43 and for generating a number of "on" signals, and may include a hole or an aperture or a blank for not reflecting the light to the light receiving device 43 and for generating one or more "off" signals, The "on" and the "off" signals from the reflective member and the blank of the target wheel 30 may also be provided for further precisely determining the relative or positive positions between or of the reference wheel 20 and the target wheel 30 and the hands 72, 73 relative to the clock face 71.

Accordingly, the timepiece in accordance with the present invention includes a simplified device or configuration for detecting and correcting the relative positions of rotary members and hands of the timepiece, and includes an initializing or starting code for positively determining the aperture of the first rotary member and thus for easily and readily detecting and correcting the relative positions of rotary members and hands of the timepiece.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A timepiece comprising:

a light emitting device for generating a light, a reference wheel including at least one first reflective member provided thereon for reflecting the light generated by said light emitting device, and at least one orifice formed therein for receiving the light generated by said light emitting device, a target wheel including at least one second reflective member provided thereon for reflecting the light generated by said light emitting device, means for driving said reference wheel and said target wheel separately, a light receiving device for receiving the light reflected from either said at least one first reflective member or said at least one second reflective member, to determine at least one first "on" signal when said light receiving device receives the light reflected from said at least one first reflective member of said reference wheel, and to determine at least one second "on" signal when said light receiving device receives the light reflected from said at least one second reflective member of said target wheel, and to determine at least one "off" signal when said light receiving device receives no light reflected from said reference wheel, and to determine a starting code with said at least one first "on" signal and said at least one "off" signal, processor means for actuating said driving means to rotate said reference wheel and to align said at least one orifice of said reference wheel with said light emitting device and to allow the light generated by said light emitting device to emit through said at least one orifice of said reference wheel when said processor means receives said starting code from said light receiving device, and said processor means being provided for actuating said driving means to rotate said target wheel and to align said at least one second reflective member of said target wheel with said light emitting device after said at least one orifice of said reference wheel is aligned with said light emitting device.

2. The timepiece according to claim 1, wherein said at least one first "on" signal of said starting code is provided after said at least one "off" signal of said starting code.

3. The timepiece according to claim 1, wherein said at least one first "on" signal of said starting code is provided before said at least one "off" signal of said starting code.

4. The timepiece according to claim 1 further comprising memorizing means for storing a time signal, said processor means being provided for actuating said driving means to rotate said reference wheel and said target wheel and to the time signal stored in said memorizing means.

5. The timepiece according to claim 4 further comprising means for receiving the time signal and sending the time signal to said memorizing means.

6. The timepiece according to claim 1, wherein said light receiving device is provided to determine at least one second "off" signal when said light receiving device receives no light reflected from said at least one second reflective member of said target wheel, and said processor means determines the position of said target wheel with said at least one second "off" signal and said at least one second "on" signal.

* * * * *